US009004413B2

(12) United States Patent
Kurita

(10) Patent No.: US 9,004,413 B2
(45) Date of Patent: Apr. 14, 2015

(54) TRAIN CONTROL SYSTEM

(71) Applicant: The Nippon Signal Co., Ltd., Tokyo (JP)

(72) Inventor: Akira Kurita, Kuki (JP)

(73) Assignee: The Nippon Signal Co., Ltd., Tokyo (JP)

( * ) Notice: Subject to any disclaimer, the term of this patent is extended or adjusted under 35 U.S.C. 154(b) by 0 days.

(21) Appl. No.: 14/227,671

(22) Filed: Mar. 27, 2014

(65) Prior Publication Data

US 2014/0209761 A1 Jul. 31, 2014

Related U.S. Application Data

(63) Continuation of application No. PCT/JP2012/074375, filed on Sep. 24, 2012.

(30) Foreign Application Priority Data

Sep. 30, 2011 (JP) ..... 2011-218249

(51) Int. Cl.

| | |
|---|---|
| ***B61L 3/06*** | (2006.01) |
| ***B61L 3/00*** | (2006.01) |
| ***B61L 3/12*** | (2006.01) |
| ***B61L 25/02*** | (2006.01) |
| ***B61L 27/00*** | (2006.01) |
| ***B61L 25/00*** | (2006.01) |

(52) U.S. Cl.

CPC . *B61L 3/00* (2013.01); *B61L 3/125* (2013.01); *B61L 25/025* (2013.01); *B61L 27/0027* (2013.01); *B61L 25/00* (2013.01); *B61L 25/026* (2013.01)

(58) Field of Classification Search

CPC ..... B61L 27/00; B61L 3/12; B61L 25/02
USPC ..... 246/2, 2 S, 2 R, 4, 6, 122 R, 167 R, 29 R
See application file for complete search history.

(56) References Cited

U.S. PATENT DOCUMENTS

| | | | | |
|---|---|---|---|---|
| 4,532,511 | A * | 7/1985 | Lemelson | 340/933 |
| 7,201,350 | B2 * | 4/2007 | Sugita et al. | 246/122 R |
| 7,742,849 | B2 * | 6/2010 | Muinonen et al. | 701/19 |
| 7,983,806 | B2 * | 7/2011 | Muinonen et al. | 701/19 |

(Continued)

FOREIGN PATENT DOCUMENTS

| | | |
|---|---|---|
| JP | 2007-331629 A | 12/2007 |
| JP | 2010-089639 A | 4/2010 |
| JP | 2011-192193 A | 9/2011 |

*Primary Examiner* — Jason C Smith
(74) *Attorney, Agent, or Firm* — Foley & Lardner LLP

(57) ABSTRACT

With respect to each of trains, a ground device 6 detects a train location in the control section on the basis of a propagation time of a radio wave between a vehicle radio set 4 and a wayside radio set 5, in the case in which the ground device 6 determines that the number of trains has reached the controllable number of trains or there is the possibility that the number of trains reaches the controllable number of trains in its own control section, a ground device 6 disposed in an adjacent control section to the control section in which the number of trains is reaching the controllable number of trains, when a train 2 scheduled to travel toward the control section stops in a station 8, prevents departure of the train 2 scheduled to pass through the border of the control section by making the train 2 wait at the station 8.

5 Claims, 3 Drawing Sheets

(56) References Cited

U.S. PATENT DOCUMENTS

| | | | | |
|---|---|---|---|---|
| 8,239,080 | B2 * | 8/2012 | Chun | 701/19 |
| 2005/0133673 | A1 * | 6/2005 | Sugita et al. | 246/167 R |
| 2008/0068164 | A1 * | 3/2008 | Campbell | 340/572.1 |
| 2011/0186692 | A1 * | 8/2011 | Kumar et al. | 246/29 R |
| 2013/0193276 | A1 * | 8/2013 | Hunter | 246/122 R |
| 2013/0248658 | A1 * | 9/2013 | Takagi | 246/122 R |
| 2014/0012438 | A1 * | 1/2014 | Shoppa et al. | 701/19 |
| 2014/0042279 | A1 * | 2/2014 | Kadono et al. | 246/167 R |
| 2014/0054424 | A1 * | 2/2014 | Xu et al. | 246/122 R |
| 2014/0103166 | A1 * | 4/2014 | Asuka et al. | 246/4 |
| 2014/0131524 | A1 * | 5/2014 | Grimm et al. | 246/3 |
| 2014/0138495 | A1 * | 5/2014 | Lostun et al. | 246/219 |
| 2014/0172205 | A1 * | 6/2014 | Ruhland et al. | 701/19 |

* cited by examiner

TRAIN CONTROL SYSTEM

This application is a continuation application of PCT/JP2012/074375, filed on Sep. 24, 2012.

BACKGROUND OF THE INVENTION

1. Field of the Invention

The present invention relates to a train control system, and more specifically, relates to a train control system of detecting a train location by using radio distance measurement and controlling the train.

2. Description of Related Art

Conventionally, in a train control system using a so-called radio distance measurement system, a vehicle radio set is mounted on a train, a wireless network is formed between the vehicle radio set and a plurality of wayside radio sets which is disposed along a wayside of a track on which the train travels, and then, wireless radio propagation delay (time) between an on-board antennal of the vehicle radio set and a wayside antenna of the wayside radio set is measured, to detect a train location, so that train control is performed on the basis of the detected train location.

As a train control system using such a radio distance measurement system, conventionally, for example, a technique including: wireless train location detecting unit that detects a train location on a predetermined track on the basis of a propagation time of a radio wave between a vehicle radio set mounted on a train traveling on the predetermined track and a ground radio set disposed at a predetermined location on the ground; a travel distance calculating unit that calculates a travel distance of the train on the predetermined tack on the basis of an output signal of a speed generator (tachometer generator) connected to an axle of the train; a temporary reference location setting unit that sets the train location detected by the wireless train location detecting unit as a predetermined temporary reference location; and train location detection calculating unit that detects a train location on the predetermined track on the basis of the temporary reference location set by the temporary reference location setting unit and on the basis of the travel distance calculated by the travel distance calculating unit, has been disclosed (refer to, for example, Japanese Laid-open (Kokai) Patent Application Publication No. 2007-331629).

However, in the conventional technique, generally, a railroad track is divided into a plurality of control sections, wayside radio sets which control in each control section are set, and a ground device which controls the wayside radio sets in each control section allocates communication resources such as communication timings and frequencies to all of trains controlled in the control section. There is a problem such that the number of trains to which the communication resources can be allocated in one control section is limited. Consequently, in the case in which the number of trains entering a control section exceeds the controllable number of trains, the communication resources cannot be allocated to the train, and the train cannot be controlled. Therefore, there is a problem that the train is controlled to be stopped by a security function.

In the case in which the control section is set between stations, in order to prevent the number of trains from exceeding the controllable number of trains, a train has to be stopped before a control section, and it causes deterioration in passenger service. Furthermore, for example, there is another problem such that when a train is stopped in an air section of an overhead contact line, the overhead contact line is damaged.

SUMMARY OF THE INVENTION

The present invention has been made in view of the above problem, and an object of the present invention is to provide a train control system capable of reliably controlling each of trains in the control section and achieving improved passenger service by preventing a stop control by the security function or the like.

In order to achieve the above object, an aspect of the present invention provides a train control system according to claim 1, including: a vehicle radio set that is mounted on a train traveling on a predetermined track; wayside radio sets each of which is disposed at a predetermined location on the ground; and ground devices each of which is disposed in each of control sections which are set in the track, and connected to the wayside radio sets belonging to the control section to transmit and receive information, in which, with respect to each of trains, the ground device detects a train location in the control section on the basis of a propagation time of a radio wave between the vehicle radio set and the wayside radio set, and in the case in which the ground device determines that the number of trains has reached the controllable number of trains or there is the possibility that the number of trains reaches the controllable number of trains in the control section, a ground device disposed in an adjacent control section to the control section in which the number of trains is reaching the controllable number of trains, when the train scheduled to travel toward the control section stops at a station, prevents departure of the train scheduled to pass through the border of the control section by making the train wait at the station.

Another aspect of the present invention provides a train control system according to claim 2, including: a vehicle radio set that is mounted on a train traveling on a predetermined track; wayside radio sets each of which is disposed at a predetermined location on the ground; and ground devices each of which is disposed in each of control sections which are set on the track, and connected to the wayside radio set belonging to the control section to transmit and receive information, in which, with respect to each of trains, the ground device detects a train location in the control section on the basis of a propagation time of a radio wave between the vehicle radio set and the wayside radio set, in the case in which the ground device determines that the number of trains has reached the controllable number of trains or there is the possibility that the number of trains reaches the controllable number of trains in the control section of the ground device, a ground device disposed in an adjacent control section to the control section in which the number of trains is reaching the controllable number of trains, when a train is traveling toward the control section, obtains the remaining controllable number of trains in each of the control sections, transmits a speed reduction instruction to trains traveling toward the border of each of control sections to allow the trains to travel, and, when there is allowance in the controllable number of trains traveling in the control section, the speed reduction instruction to the trains traveling to the control section is canceled to allow the trains to travel.

A further aspect of the present invention provides a train control system according to claim 3, including: a vehicle radio set that is mounted on a train traveling on a predetermined track; wayside radio sets each of which is disposed at a predetermined location on the ground; and ground devices each of which is disposed in each of control sections which are set in the track, and connected to the wayside radio set belonging to the control section to transmit and receive information, in which, with respect to each of trains, the ground device detects a train location in the control section on the basis of a propagation time of a radio wave between the vehicle radio set and the wayside radio set, in the case in which the ground device determines that the number of trains has reached the controllable number of trains or there is the possibility that the number of trains reaches the controllable number of trains in the control section, a ground device disposed in an adjacent control section to the control section in which the number of trains is reaching the controllable number of trains, when a train is traveling toward the control section, controls to stop the train in areas existing on the track other than areas in which the train cannot stop.

A further aspect of the present invention provides a train control system including: a vehicle radio set that is mounted on a train traveling on a predetermined track; wayside radio sets each of which is disposed at a predetermined location on the ground; ground devices each of which is disposed in each of control sections which are set in the track, and connected to the wayside radio set belonging to the control section to transmit and receive information; and an operation controlling device that is connected to each of the ground devices to transmit and receive information, in which, with respect to each of trains, the ground device detects a train location in the control section on the basis of a propagation time of a radio wave between the vehicle radio set and the wayside radio set, and in which, in the case in which the operation controlling device determines that the number of trains has reached the controllable number of trains or there is the possibility that the number of trains reaches the controllable number of trains in the control section of the ground device, when the train scheduled to travel toward the control section stops at a station, the operation controlling device prevents departure of the train scheduled to pass through the border of the control section by making the train wait at the station.

A further aspect of the present invention provides a train control system including: a vehicle radio set that is mounted on a train traveling on a predetermined track; wayside radio sets each of which is disposed at a predetermined location on the ground; ground devices each of which is disposed in each of control sections which are set in the track, and connected to the wayside radio set belonging to the control section; and an operation controlling device that is connected to each of the ground devices to transmit and receive information, in which, with respect to each of trains, the ground device detects a train location in the control section on the basis of a propagation time of a radio wave between the vehicle radio set and the wayside radio set, and in which, in the case in which the operation controlling device determines that the number of trains has reached the controllable number of trains or there is the possibility that the number of trains reaches the controllable number of trains in the control section of the ground device, when a train is traveling toward the control section, the operation controlling device obtains the remaining controllable number of trains in each of the control sections, transmits a speed reduction instruction to trains traveling toward the border of each of the control sections to allow the trains to travel, when there is allowance in the controllable number of trains in the control section, and cancels the speed reduction instruction to the trains traveling to the control section, to allow the trains to travel.

A further aspect of the present invention provides a train control system including: a vehicle radio set that is mounted on a train traveling on a predetermined track; wayside radio sets each of which is disposed at a predetermined location on the ground; ground devices each of which is disposed in each of control sections which are set in the track, and connected to the wayside radio set belonging to the control section; and an operation controlling device that is connected to each of the ground devices to transmit and receive information, in which, with respect to each of trains, the ground device detects a train location in the control section on the basis of a propagation time of a radio wave between the vehicle radio set and the wayside radio set, and in which, in the case in which the operation controlling device determines that the number of trains has reached the controllable number of trains or there is the possibility that the number of trains reaches the controllable number of trains in the control section of the ground device, when a train is traveling toward the control section, the ground device disposed in the control section controls to stop the train in areas existing on the track other than areas in which the train cannot stops.

According to the embodiment of the invention according to claim 1, in the case in which the number of trains traveling in a control section in the train control system has reached the controllable number of trains or there is the possibility that the number of trains reaches the controllable number of trains in the control section, a ground device, when a train is scheduled to travel toward the control section in which the number of trains has reached the controllable number of trains or there is the possibility that the number of trains reaches the controllable number of trains, prevents departure of a train scheduled to pass through a border of the control section by making the train wait at a station, when. Therefore, entering a train which cannot be controlled into the control section is reliably prevented, trains in the control section can be reliably controlled, and a stop control or the like by the security function can be prevented.

According to the embodiment of the invention according to claim 2, in the case in which it is determined that the number of trains has reached the controllable number of trains or there is the possibility that the number of trains reaches the controllable number of trains, the ground device obtains the remaining controllable number of trains in each of the control sections, and transmits a speed reduction instruction to trains traveling toward the border of each of the control sections to allow the trains to travel. Therefore, entering the train which cannot be controlled into the control section is reliably prevented, the trains in the control section can be reliably controlled, and a stop control or the like by the security function can be prevented. Furthermore, since the trains are allowed to travel according to the speed reduction instruction, the trains do not stop in some midpoint in the track. Therefore, improvement in passenger service can be achieved.

According to the embodiment of the invention according to claim 3, in the case in which the number of trains traveling in a control section of the train control system has reached the controllable number of trains or there is the possibility that the number of trains reaches the controllable number of trains in the control section, when a train has to be stopped, a ground device controls to stop the train in areas other than areas such as an air section of an overhead contact line, a slope section, and a railroad crossing, so that damage of the air section of the overhead contact line and the like can be reliably prevented.

According to the embodiment of the invention, in the case in which the number of trains traveling in a control section in the train control system has reached the controllable number of trains or there is the possibility that the number of trains reaches the controllable number of trains in the control section, when a train is scheduled to travel toward the control section in which the number of trains has reached the controllable number of trains or there is the possibility that the number of trains reaches the controllable number of trains, the operation controlling device prevents departure of a train scheduled to pass through the border of the control section by making the train wait at a station. Therefore, entering a train which cannot be controlled into the control section is reliably prevented, and trains in the control section can be reliably controlled, and the stop control or the like by the security function can be prevented.

According to the embodiment of the invention, in the case it is determined that in which the number of trains has reached the controllable number of trains or there is the possibility that the number of trains reaches the controllable number of trains, the operation controlling device obtains the remaining controllable number of trains in each of the control sections, and transmits a speed reduction instruction to trains traveling toward the border of each of the control sections to allow the trains to travel. Therefore, entering a train which cannot be controlled into the control section is reliably prevented, trains in the control section can be reliably controlled, and the stop control or the like by the security function can be prevented. Since trains are allowed to travel according to the speed reduction instruction, the trains do not stop in some midpoint in the track, so that improvement in passenger service can be achieved.

According to the embodiment of the invention, in the case in which the number of trains traveling in a control section in the train control system has reached the controllable number of trains or there is the possibility that the number of trains reaches the controllable number of trains in the control section, when a train has to be stopped, the operation controlling device stops the train in areas other than areas such as an air section of an overhead contact line, a slope section, and a railroad crossing, so that damage of the air section of the overhead contact line and the like can be reliably prevented.

DESCRIPTION OF THE PREFERRED EMBODIMENTS

Hereinbelow, an embodiment of the present invention will be described with reference to the accompanying drawings.

Figure 1:
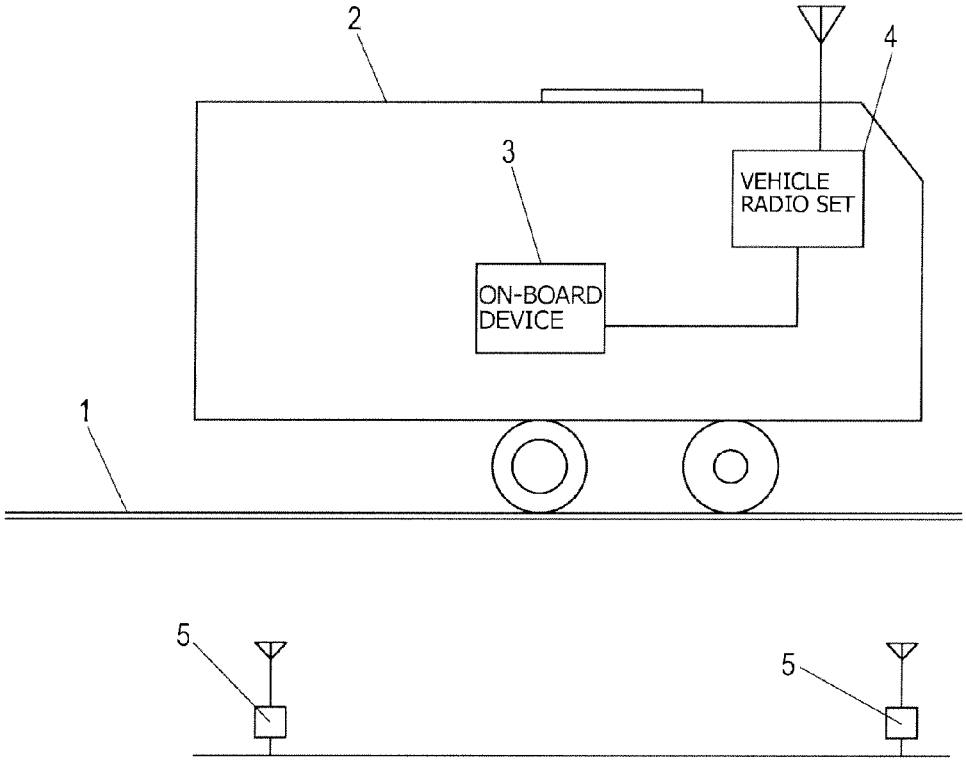
FIG. 1 is a schematic configuration view illustrating a train part in an embodiment of a train control system according to the present invention.

FIG. 1 is a schematic configuration view illustrating an embodiment of a train control system according to the present invention. In the embodiment, an on-board device 3 is mounted on a train 2 traveling on a predetermined track 1. The on-board device 3 has an arithmetic processor (not illustrated) constructed mainly by a CPU and is configured to perform various controls such as a speed control and a braking control of the train 2.

Figure 2:
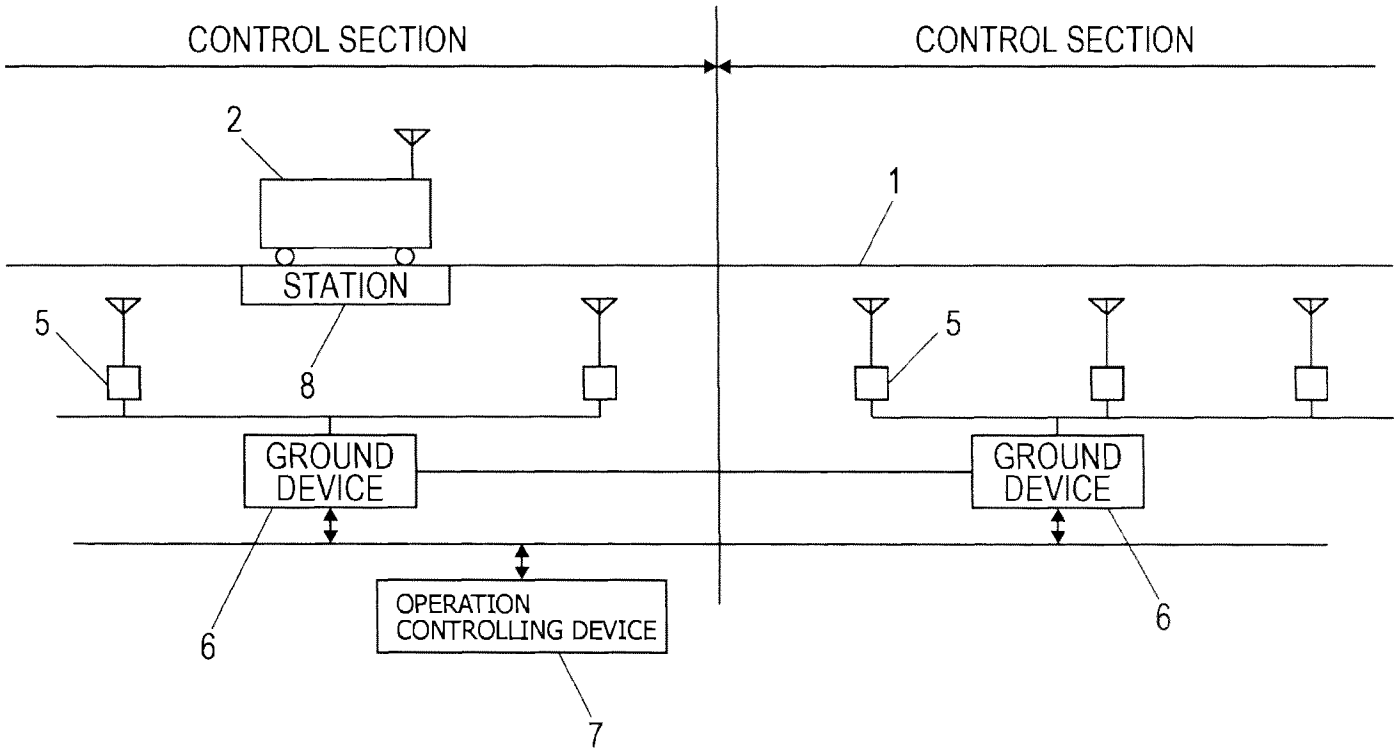
FIG. 2 is a schematic configuration view illustrating an embodiment of the train control system according to the present invention.

On the train 2, a vehicle radio set 4 connected to the on-board device 3 is also mounted, and a plurality of wayside radio sets 5 that transmits information to and receives information from the vehicle radio set 4, are disposed along a wayside of the track 1 of the train 2. As illustrated in FIG. 2, the wayside radio sets 5 are allocated in a plurality of control sections formed along the track 1, and information is transmitted and received between the wayside radio sets 5 belonging to a predetermined control section and the vehicle radio set 4 on the train 2 traveling in the predetermined control section.

A ground device 6 is disposed in each of the control sections, and the wayside radio sets 5 belonging to a control section in which the ground device 6 is disposed are connected to the ground device 6. The ground devices 6 are connected to each other, and the ground devices 6 are configured so as to be able to transmit information to and receive information from the other ground devices 6. Furthermore, to the ground devices 6, an operation controlling device 7 performing operation control of the railroads of the train 2 is connected.

The operation controlling device 7 transmits number information and operation schedule information of the train 2 to each of the ground devices 6, and each of the ground devices 6 computes the distance between the wayside radio set 5 and the train 2 by measuring communication time when the communication between the wayside radio set 5 and the vehicle radio set 4 is performed, and detects the currently location at which the train 2 of the corresponding number exists in the control section. Information of limiting speed and a possible travel distance based on train location information is transmitted from the ground device 6 via the wayside radio set 5 and the vehicle radio set 4 to the on-board device 3, and the on-board device 3 generates a speed pattern in accordance with the brake performance of the train 2 on which the on-board device 3 is mounted and, when travel speed exceeds the speed pattern, reduces travel speed equal to or less than the speed pattern by controlling the brake device.

The ground device 6 detects all of train locations in the control section in which it is disposed, and allocates a communication timing, frequency, and the like to each of the trains 2. In this case, the number of trains 2 which can be controlled by one ground device 6 is determined in advance. When the number of trains 2 exceeds the controllable number of trains, the ground device 6 cannot communication with the excess train(s) 2, and cannot control the excess train(s) 2. Therefore, in the embodiment, when each of the ground devices 6 determines that the number of trains has reached the controllable number of trains or there is the possibility that the number of trains reaches the controllable number of trains in its own control section, the ground device 6 transmits a message indicative of that the determination to the other ground devices 6. Furthermore, in the case in which a train 2 is scheduled to travel toward the control section in which the number of trains has reached the controllable number of trains or there is the possibility that the number of trains reaches the controllable number of trains, when the train 2 which is scheduled to travel toward the control section stops at a station 8, each of the ground devices 6 prevents the train 2 scheduled to pass through the border of the control sections from departing by making the train 2 wait at the station 8.

In the case in which after the transmission of message indicating that it is determined that the number of trains has reached the controllable number of trains or there is the possibility that the number of trains reaches the controllable number of trains in a control section in the train control system, the train 2 has already left the station 8 toward the control section, a ground device 6 obtains the remaining controllable number of trains in each of the control sections, transmits a speed reduction instruction to trains 2 traveling toward the border of each of the control sections to allow the trains 2 to travel, and then when there is allowance in the controllable number of trains in the control section, the ground device 6 cancels the speed reduction instruction to the control section to allow the trains 2 to travel.

Furthermore, in the case in which after the transmission of message indicating that it is determined that the number of trains has reached the controllable number of trains or there is the possibility that the number of trains reaches the controllable number of trains in a control section in the train control system, the train 2 is already traveling toward the control section and thus the train 2 has to be stopped, a ground device 6 controls to stop the train 2 in areas other than areas such as an air section of an overhead contact line, a slope section, and a railroad crossing which are defined in advance in a database of the operation controlling device 7.

Figure 3:
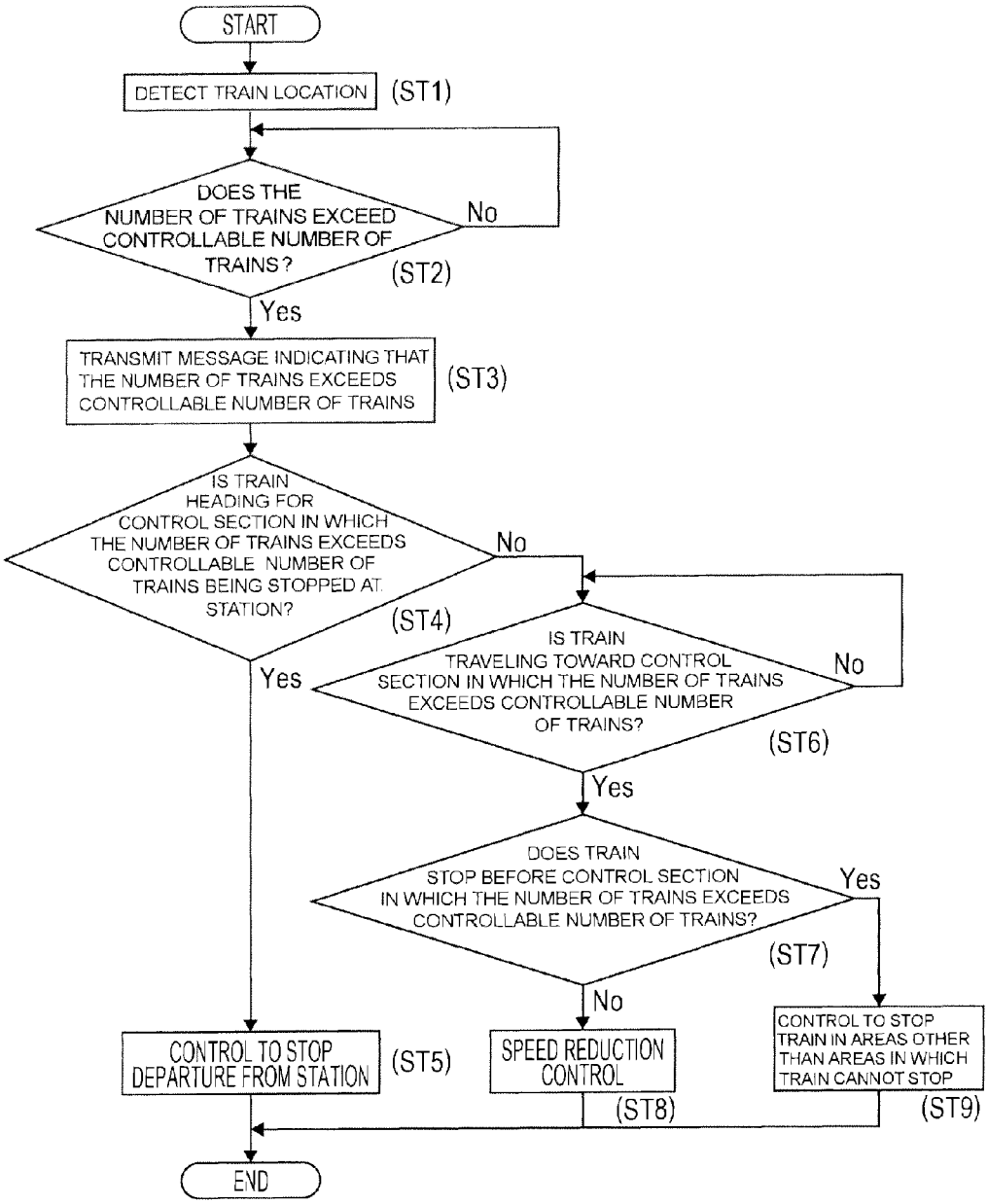
FIG. 3 is a flowchart illustrating operations in the embodiment of the train control system according to the present invention.

Next, the control operation of the embodiment will be described with reference to the flowchart illustrated in FIG. 3.

First, communication is performed between the wayside radio set 5 and the vehicle radio set 4, by measuring the communication time, each of the ground devices 6 computes the distance between the wayside radio set 5 and the train 2, and detects the currently location at which the train 2 exists in the control section (ST1).

Information of limiting speed and a possible travel distance based on the train location information is transmitted from the ground device 6 via the wayside radio set 5 and the vehicle radio set 4 to the on-board device 3, and the on-board device 3 generates a speed pattern in accordance with the brake performance of the train 2 on which the on-board device 3 is mounted, and performs travel control of the train 2 in accordance with the speed pattern.

Each of the ground devices 6 determines whether the number of trains traveling in its own control section has reached the controllable number of trains or there is the possibility that the number of trains reaches the controllable number of trains (ST2). In the case in which it is determined that the number of trains has reached the controllable number of trains or that there is the possibility that the number of trains reaches the controllable number of trains (YES in ST2), the ground device 6 transmits a message indicative of the determination to the other ground devices 6 (ST3). In the case in which, on the basis of number information and operation schedule information of the train 2 transmitted from the operation controlling device 7, a train 2 is scheduled to travel toward a control section in which the number of trains has reached the controllable number of trains or there is the possibility that the number of trains reaches the controllable number of trains, each of the ground device 6 determines whether the train 2 scheduled to travel toward the control sections stops at the station 8 or not (ST4). In the case in which the train 2 stops at the station 8 (YES in ST4), the train 2 scheduled to pass through the border of the control sections is made wait in the station 8 to prevent the train 2 from leaving (ST5).

In the case in which, after transmission of the message indicating that it is determined that the number of trains has reached the controllable number of trains or there is the possibility that the number of trains reaches the controllable number of trains in a control section in the train control system, a train 2 is not stopping in the station 8 and has already left toward the control section (NO in ST4), a ground device 6 obtains the remaining controllable number of trains in each of control sections, in the case in which the train 2 travels toward the border of the control sections (YES in ST6) and the train 2 does not stop before the control section in which the number of trains exceeds the controllable number of trains (NO in ST7), a speed reduction instruction is transmitted to the train 2, and the train 2 is allowed to travel (ST8).

Furthermore, in the case in which, after transmission of the message indicating that it is determined that the number of trains has reached the controllable number of trains or there is the possibility that the number of trains reaches the controllable number of trains in the control section the train control system, a train 2 is already traveling toward the control section and thus the train 2 has to be stopped (YES in ST7), a ground device 6 controls to stop the train 2 in areas other than areas such as an air section of an overhead contact line, a slope section, and a railroad crossing which are defined in advance in a database of the operation controlling device 7 (ST9).

As described above, in the embodiment, in the case in which the number of trains traveling in a control section in the train control system has reached the controllable number of trains or there is the possibility that the number of trains reaches the controllable number of trains in the control section, when a train 2 is scheduled to travel toward the control section in which the number of trains has reached the controllable number of trains or there is the possibility that the number of trains reaches the controllable number of trains, a ground device 6 prevents departure of the train 2 scheduled to pass through the border of the control sections by making the train 2 wait in the station 8. Therefore, entering the train 2 which cannot be controlled into the control section can be reliably prevented, the trains 2 in the control section can be reliably controlled, and the stop control or the like by the safety function can be prevented. As a result, improvement in passenger service can be achieved.

In the case in which it is determined that the number of trains has reached the controllable number of trains or there is the possibility that the number of trains reaches the controllable number of trains in a control section in the train control system, a ground device 6 obtains the remaining controllable number of trains in each of the control sections, transmits a speed reduction instruction to trains 2 traveling toward the border of each of the control sections to allow the trains 2 to travel. Therefore, entering the train 2 which cannot be controlled into the control section can be reliably prevented, the trains 2 in the control section can be reliably controlled, and the stop control or the like by the safety function can be prevented. Since the trains 2 are allowed to travel according to the speed reduction instruction, the trains 2 do not stop in some midpoint of the track 1. As a result, improvement in passenger service can be achieved.

Furthermore, in the case in which the number of trains has reached the controllable number of trains or there is the possibility that the number of trains reaches the controllable number of trains in a control section in the train control system and thus a train 2 has to be controlled to be stopped, the ground device 6 controls to stop the train 2 in areas other than areas such as such as an air section of an overhead contact line, a slope section, and a railroad crossing. Thus, a damage of the air section of the overhead contact line or the like can be reliably prevented.

In the embodiment, in the case in which it is determined that the number of trains has reached the controllable number of trains or there is the possibility that the number of trains reaches the controllable number of trains in a control section in the train control system, a ground device 6 prevents a train from departing a station 8, and performs the speed reduction control or the stop control in areas other than areas in which a train cannot stop. Alternately, the operation controlling device 7 may obtain information from the ground devices 6 and control them.

It should be noted that the entire contents of Japanese Patent Application No. 2011-218249, filed on Sep. 30, 2011, on which convention priority is claimed, is incorporated herein by reference.

It should also be understood that many modifications and variations of the described embodiments of the invention will be apparent to a person having an ordinary skill in the art without departing from the spirit and scope of the present invention as claimed in the appended claims.

What is claimed is:

1. A train control system comprising:

a vehicle radio set that is mounted on a train traveling on a predetermined track;

wayside radio sets each disposed at a predetermined location on the ground and configured to transmit information to and receive information from the vehicle radio set; and ground devices each disposed in each of control sections which are set in the track and connected to the wayside radio set belonging to the control section in which the ground device is disposed, each of the ground devices being configured to transmit information to and receive information from the other ground devices, wherein, each of the ground devices detects train locations in the control section in which the ground device is disposed, and wherein each of the ground devices, in the case of determining that the number of trains has reached the controllable number of trains or there is the possibility that the number of trains reaches the controllable number of trains in the control section, transmits information indicating that the number of trains has reached the controllable number of trains, or that there is the possibility that the number of trains reaches the controllable number of trains, to the other around devices.

2. The train control system according to claim 1, wherein, after the transmission of the information to the other ground devices, a ground device disposed in an adjacent control section to a control section in which the number of trains has reached the controllable number of trains, or that there is the possibility that the number of trains reaches the controllable number of trains, when a train is traveling toward the control section, transmits a speed reduction instruction to the train traveling toward the control section to allow the train to travel, and, when there is allowance in the controllable number of trains in the control section, cancels the speed reduction instruction to the train traveling to the control section.

3. The train control system according to claim 1, wherein, after the transmission of the information to the other ground devices, a ground device disposed in an adjacent control section to a control section in which the number of trains has reached the controllable number of trains, or that there is the possibility that the number of trains reaches the controllable number of trains, when a train is traveling toward the control section, controls to stop the train traveling toward the control section in areas existing on the track other than areas in which the train cannot stop.

4. The train control system according to claim 1, wherein, after the transmission of the information to the other ground devices, a ground device disposed in an adjacent control section to a control section in which the number of trains has reached the controllable number of trains, or that there is the possibility that the number of trains reaches the controllable number of trains, when a train scheduled to travel toward the control section stops at a station, prevents the stopped train from departing by controlling the stopped train to wait at the station.

5. The train control system according to claim 1, wherein each of the ground devices detects each train location in a control section in which the ground device is disposed on the basis of a propagation time of a radio wave between the vehicle radio set and the wayside radio set.

* * * * *